US006603468B2

(12) United States Patent
Ooishi et al.

(10) Patent No.: US 6,603,468 B2
(45) Date of Patent: Aug. 5, 2003

(54) LIQUID CRYSTAL DISPLAY DEVICE FOR DISPLAYING DISPLAY DATA

(75) Inventors: Yoshihisa Ooishi, Yokohama (JP); Hiroyuki Nitta, Fujisawa (JP); Akihiro Watanabe, Mobara (JP); Hirobumi Koshi, Chosei (JP); Satoru Tsunekawa, Kodaira (JP)

(73) Assignees: Hitachi, Ltd., Tokyo (JP); Hitachi Device Engineering, Chiba (JP)

( * ) Notice: Subject to any disclaimer, the term of this patent is extended or adjusted under 35 U.S.C. 154(b) by 202 days.

(21) Appl. No.: 09/796,633

(22) Filed: Mar. 2, 2001

(65) Prior Publication Data

US 2002/0003533 A1 Jan. 10, 2002

(30) Foreign Application Priority Data

Jul. 6, 2000 (JP) ..... 2000-210685

(51) Int. Cl.[7] ..... G09G 5/00
(52) U.S. Cl. ..... 345/204; 345/99
(58) Field of Search ..... 345/99, 98, 100, 345/204; 327/89, 159, 94, 100

(56) References Cited

U.S. PATENT DOCUMENTS 5,359,343 A * 10/1994 Nakamura ..... 345/100
5,399,912 A * 3/1995 Murata et al. ..... 327/94
5,801,554 A * 9/1998 Momma et al. ..... 327/89
5,845,108 A * 12/1998 Yoo et al. ..... 713/400
6,262,611 B1 * 7/2001 Takeuchi ..... 327/159
6,333,895 B1 * 12/2001 Hamamoto et al. ..... 365/233

* cited by examiner

*Primary Examiner*—Amare Mengistu
(74) *Attorney, Agent, or Firm*—Antonelli, Terry, Stout, & Kraus, LLP

(57) ABSTRACT

A liquid crystal display device includes a liquid crystal panel; a plurality of data drivers for applying, to the pixel elements, graduation voltages corresponding to the display data; a gate driver for selecting a pixel element to which a graduation voltage is to be applied; and a liquid crystal control circuit for controlling the data drivers on the basis of a transfer clock. Each data driver includes a reproducing circuit for reproducing the transfer clock input to the data driver such that the deviations between the duties of the display data and the transfer clock input to the data driver and the duties of the display data and the transfer clock output from the data driver become small, and for generating a latch clock, and a latch circuit for latching the display data input to the data driver.

9 Claims, 10 Drawing Sheets

LIQUID CRYSTAL DISPLAY DEVICE FOR DISPLAYING DISPLAY DATA

BACKGROUND OF THE INVENTION

1. Field of the Invention

The present invention relates to a liquid crystal display device provided with a plurality of data drivers.

2. Description of the Related Art

There is described a liquid crystal display device in Japanese Patent Application Laid-open No. 11-194748 wherein a plurality of data drivers are connected in series by transmission lines to transmit display data and a data transfer clock. Each data driver is also provided with a buffer circuit between the transmission lines on either of the input and output sides.

The above related art, however, does not consider a change in duty ratio of transmitted pulse that may arise when a pulse transmission is performed. For example, in the case that the response characteristic of each buffer circuit is duller at a rise of a transmitted pulse than that at a fall thereof, the rise of the transmitted signal is delayed every time when it passes through a buffer circuit. This brings about a reduction of the transmission quality because the pulse width is decreased.

Even if the logic level of the transmitted signal (display data and a data transfer clock) is inverted every time when it passes through the buffer circuit on the output side of a data driver, a difference in duty once produced can not be canceled. For example, when the duty is 50% at the first data driver and 45% at the third data driver, it is expected to be about 40% at the fifth data driver. To say the least, it is not expected that the duty return to 50% again.

Further, in dual edge transfer wherein display data is taken in at rise/fall of a transfer clock, the margin of either of setup/hold times for each rising edge of the transfer clock differs from that for each falling edge. More specifically, in dual edge drive, since the transfer clock and display data have the same maximum frequency, the same line width for the transfer clock and the display data is used in input/output buffers and transmission lines. The difference in either of the delay time upon rise and the delay time upon fall between the transfer clock and the display data can thereby be narrowed within each path from the output buffer of one data driver to the input buffer of the next data driver. On the other hand, the delay time upon rise differs from that upon fall. As a result, some problems may arise. For example, for each rising edge of the transfer clock, the margin of the hold time is small though the margin of the setup time is sufficient. Inversely, for each falling edge of the transfer clock, the margin of the setup time is small though the margin of the hold time is sufficient. Sufficient margins of the setup/hold times are required for either edge. Consequently, the margin of either of the setup/hold times becomes insufficient.

SUMMARY OF THE INVENTION

It is an object of the present invention to provide liquid crystal display devices wherein changes in transfer clock and display data are suppressed.

It is another object of the present invention to provide liquid crystal display devices wherein there are increased margins of setup/hold times for display data.

In the present invention, a transfer clock input to a data driver is reproduced such that the deviations between the duties of the display data and the transfer clock input to the data driver and the duties of the display data and the transfer clock output from the data driver become small, and a latch clock is generated. The display data input to the data driver is latched on the basis of the latch clock.

Besides, in the present invention, a latch clock is generated on the basis of a transfer clock so as to increase the margins of setup/hole times of display data input to a data driver. The display data is latched on the basis of the latch clock. Preferably, the latch clock is generated such that it rises earlier than the transfer clock by a period t, and falls later than the transfer clock by the period t.

DETAILED DESCRIPTION OF THE EMBODIMENTS

The first embodiment of the present invention will be described below with reference to FIGS. 1 to 10.

Figure 1:
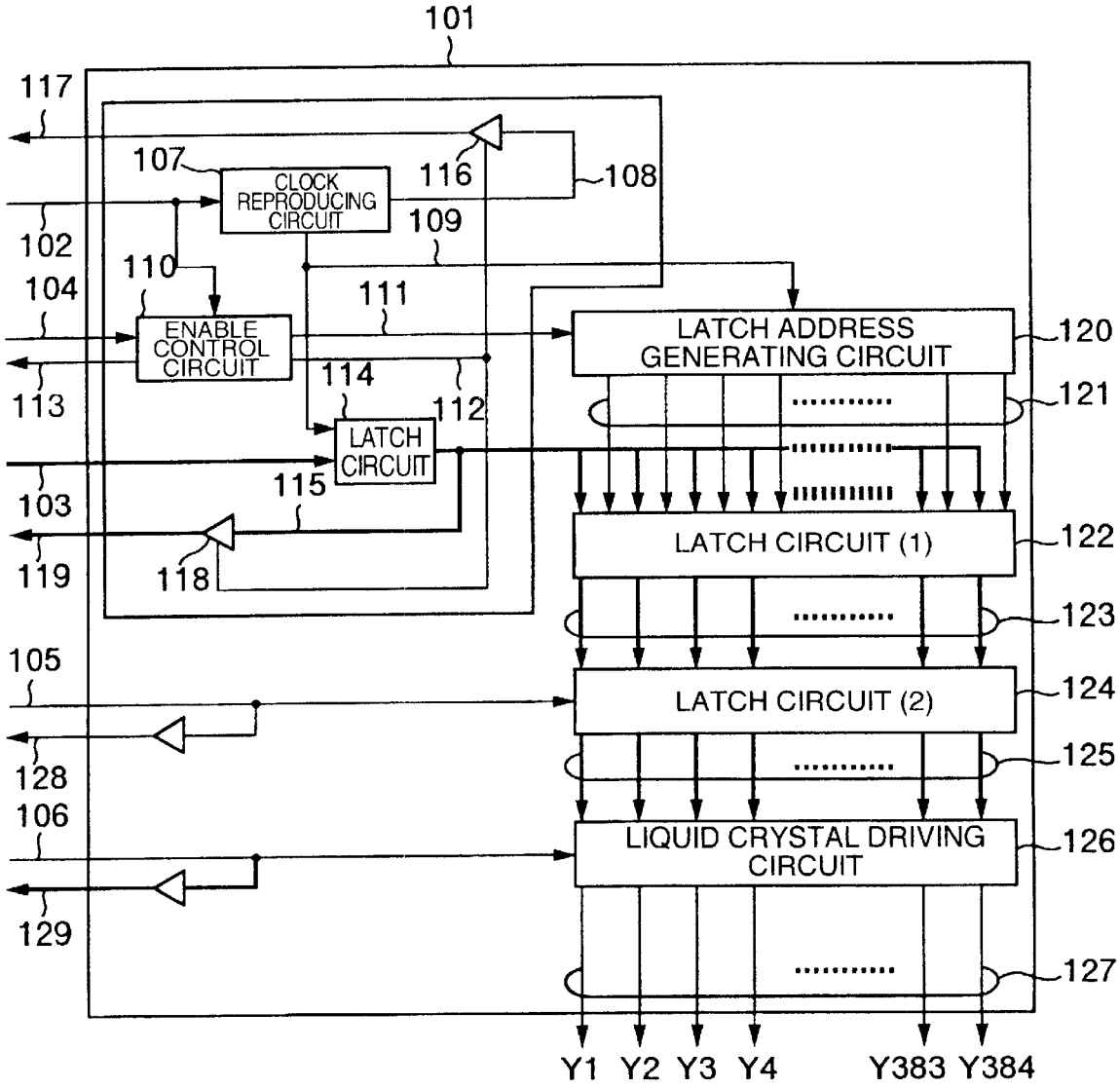
FIG. 1 is a block circuit diagram showing the construction of a data driver according to the first embodiment of the present invention.

FIG. 1 is a block circuit diagram showing the construction of a data driver according to the first embodiment. Reference numeral 101 denotes a data driver for outputting graduation voltages in accordance with display data, which driver includes 384 liquid crystal output lines in this embodiment. Reference numeral 102 denotes an input transfer clock, 103 does input display data, and 104 does an input enable signal. The data driver 101 takes the display data 103 in at each rising edge and each falling edge of the input transfer clock 102 on the basis of an input enable signal 104. Reference numeral 105 denotes an input liquid crystal application signal including a graduation voltage in accordance with the display data, and 106 does an input liquid crystal reference voltage for determining a graduation voltage to be output to a liquid crystal display panel. Reference numeral 107 denotes a clock reproducing circuit, 108 does a reproduced transfer clock reproduced in the clock reproducing circuit on the basis of the input transfer clock 102, and 109 does a latch clock, which is the doubled signal of the reproduced transfer clock 108. Reference numeral 110 denotes an enable control circuit, 111 does a latch address start signal, 112 does an output start signal, and 113 does an output enable signal. These signals 111 to 113 are generated in the enable control circuit 110 on the basis of the input enable signal 104 and the input transfer clock 102. Reference numeral 114 denotes a latch circuit for latching the input display data 103 at each rising edge of the latch clock 109, and 115 does display data latched by the latch circuit 114. Reference numerals 116 and 118 denote output buffers, which are in a high-impedance state when the output start signal 112 is at low level. Reference numeral 117 denotes an output transfer clock, and 119 does output display data. Reference numeral 120 denotes a latch address generating circuit, and 121 is a latch address. The latch address 121 is generated in the latch address generating circuit 120 on the basis of the latch clock 109 and the latch address start signal 111. Reference numeral 122 denotes a latch circuit (1), and 123 does display data taken in the latch circuit (1) 122 on the basis of the latch address 121. Reference numeral 124 denotes a latch circuit (2), and 125 does display data output from the latch circuit (2) 124 on the basis of the input liquid crystal application signal 105. Reference numeral 126 denotes a liquid crystal driving circuit, and 127 does a liquid crystal application voltage generated from the input liquid crystal reference voltage on the basis of the display data 125. Reference numeral 128 denotes an output liquid crystal application signal obtained by buffering the input liquid crystal application signal 105, and 129 does an output liquid crystal reference voltage obtained by amplifying the input liquid crystal reference voltage 106 through an electric current.

Figure 2:
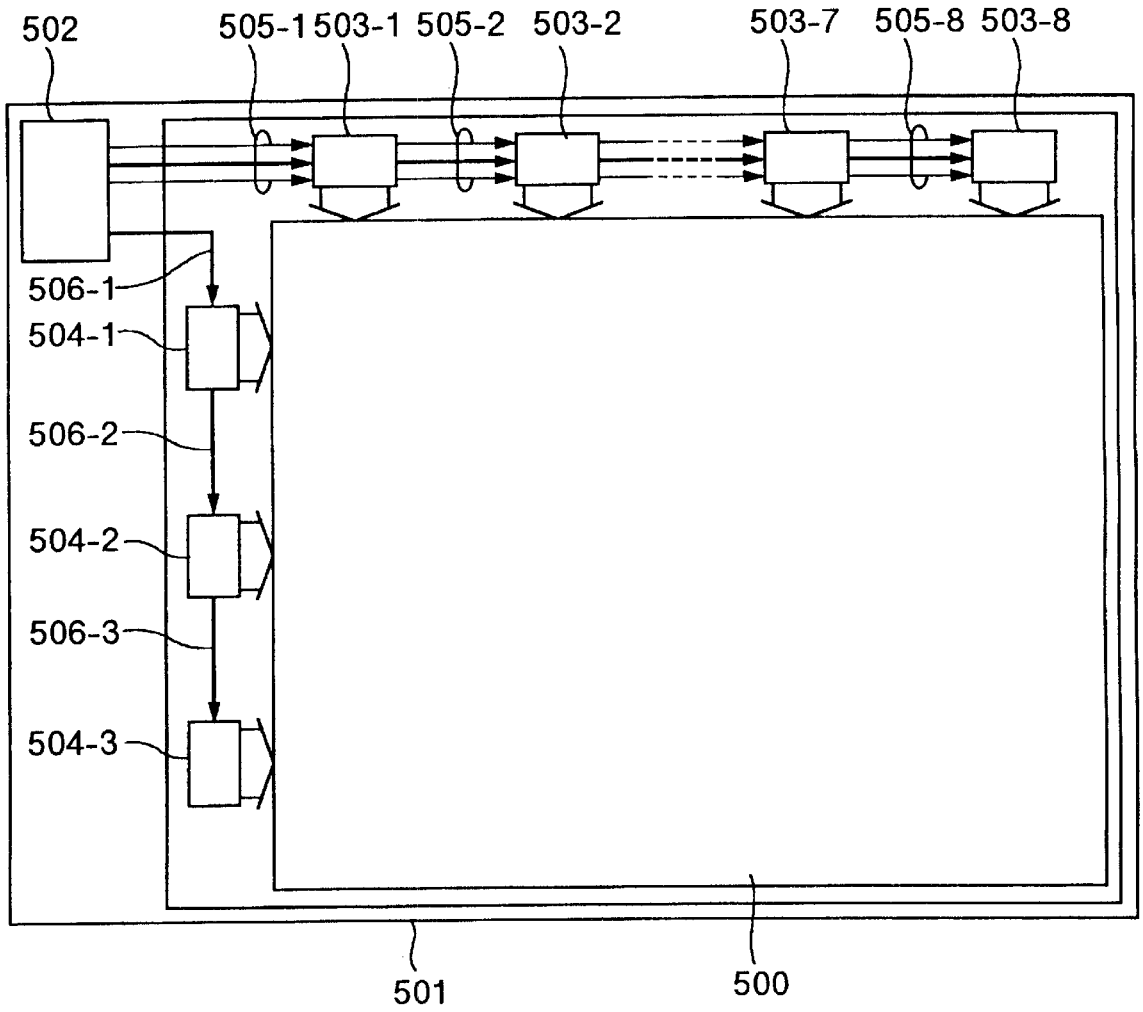
FIG. 2 is a block diagram showing the construction of a liquid crystal display device according to the first embodiment.
Figure 3:
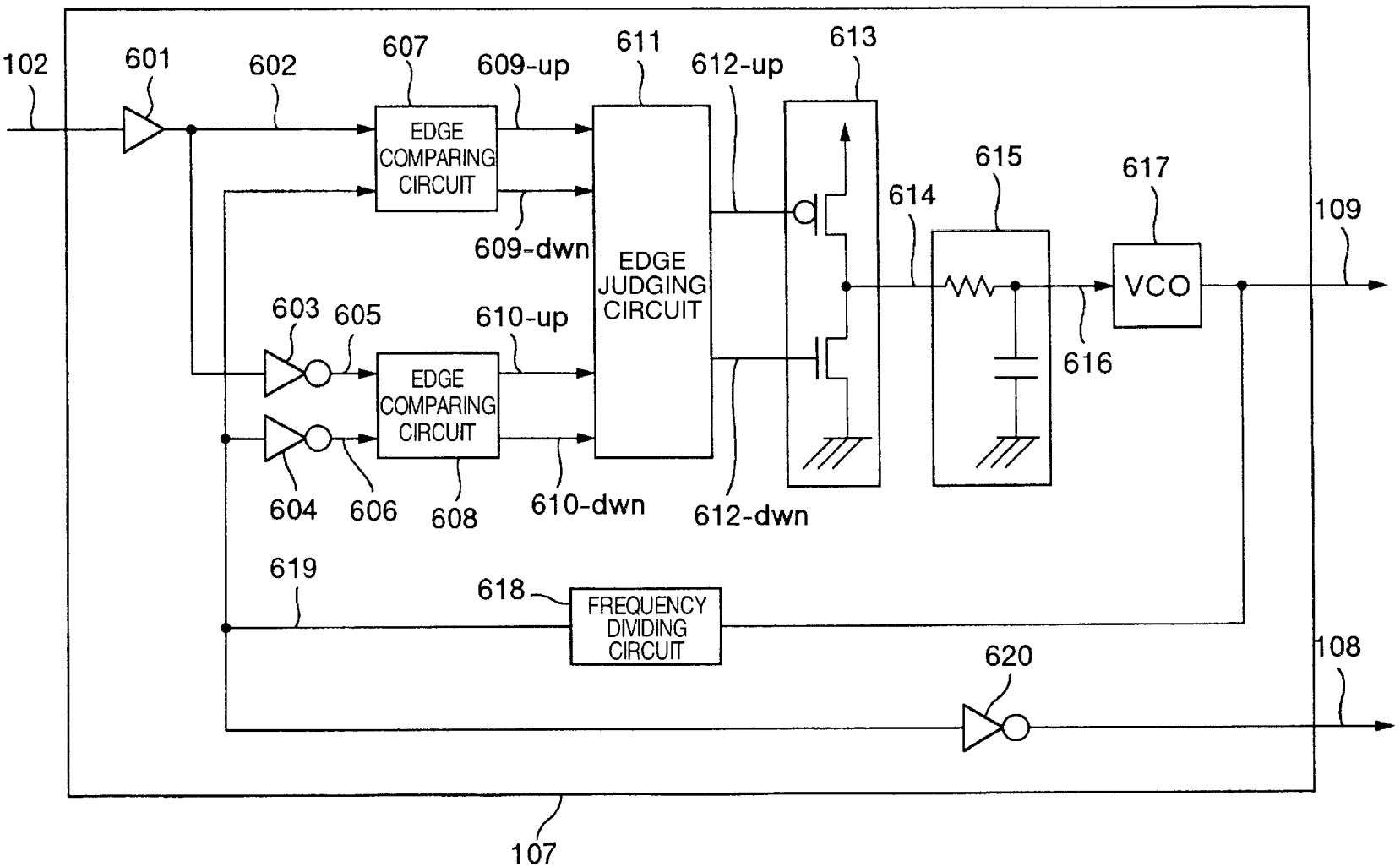
FIG. 3 is a block circuit diagram showing the construction of a clock reproducing circuit according to the first embodiment.

FIG. 2 is a block diagram showing the construction of a liquid crystal display device according to the present invention. Reference numeral 500 denotes a liquid crystal display panel including pixel elements arranged in a matrix form, and 501 does a liquid crystal display device. The size of the display area in this embodiment is according to a standard, e.g., called XGA of 1024×3 (RGB)×768. Reference numeral 502 denotes a liquid crystal controller, 503-1 to 503-8 do data drivers as shown in FIG. 1, and 504-1 to 504-3 do gate drivers for outputting selection voltages for selecting a pixel (scan line) to which a graduation voltage is applied. Each gate driver includes 256 outputs. The data drivers 503-1 to 503-8 and the gate drivers 504-1 to 504-3 are disposed on a glass substrate of the liquid crystal display panel 500. Reference numerals 505-1 to 505-8 denote data driver signal groups, which are connected between the liquid crystal controller 502 and the data driver 503 at the preceding stage and the data driver at the subsequent stage. Reference numerals 506-1 to 506-3 denote gate driver signal groups, which are connected between the liquid crystal controller 502 and the gate driver at the preceding stage and the gate data at the subsequent stage like the data driver signal groups.

FIG. 3 is a block circuit diagram showing the construction of the clock reproducing circuit 107. Reference numeral 601 denotes an input buffer for the input transfer clock 102, and 602 does an input transfer clock output from the input buffer 601. Reference numerals 603 and 604 denote inverting circuits, and 605 and 606 do signals obtained by inverting the input transfer clock 602 and a comparison signal 619 in the inverting circuits 603 and 604, respectively. Reference numerals 607 and 608 denote edge comparing circuits for comparing the phases of the corresponding edges in input signals with each other, and outputting the difference in phase, 609-up and 610-up do phase advance signals in the respective edge comparing circuits 607 and 608, and 609-dwn and 610-dwn do phase delay signals in the respective edge comparing circuits 607 and 608. Reference numeral 611 denotes an edge judging circuit for performing an arithmetic operation to judge each edge on the basis of the outputs of the edge comparing circuits 607 and 608, and outputting a phase advance signal 612-up or a phase delay signal 612-dwn as an operation result. Reference numeral 613 denotes a charge pump circuit, and 614 does a bias voltage. In the example shown, the charge pump circuit 613 is made into a CMOS circuit, and the bias voltage 614 varies in accordance with the logic level of the phase advance signal 612-up or the phase delay signal 612-dwn. Reference numeral 615 denotes a loop filter for removing high-frequency components from the bias voltage 614 to generate a bias voltage 616. Reference numeral 617 denotes a VCO (Voltage-Controlled Oscillator) whose output frequency varies in accordance with the input potential level. Reference numeral 618 denotes a frequency dividing circuit for dividing the frequency of the latch clock 109 to generate a comparison signal 619. Reference numeral 620 denotes an inverting circuit for the comparison signal 619, which circuit outputs the reproduced transfer clock 108.

Figure 4:
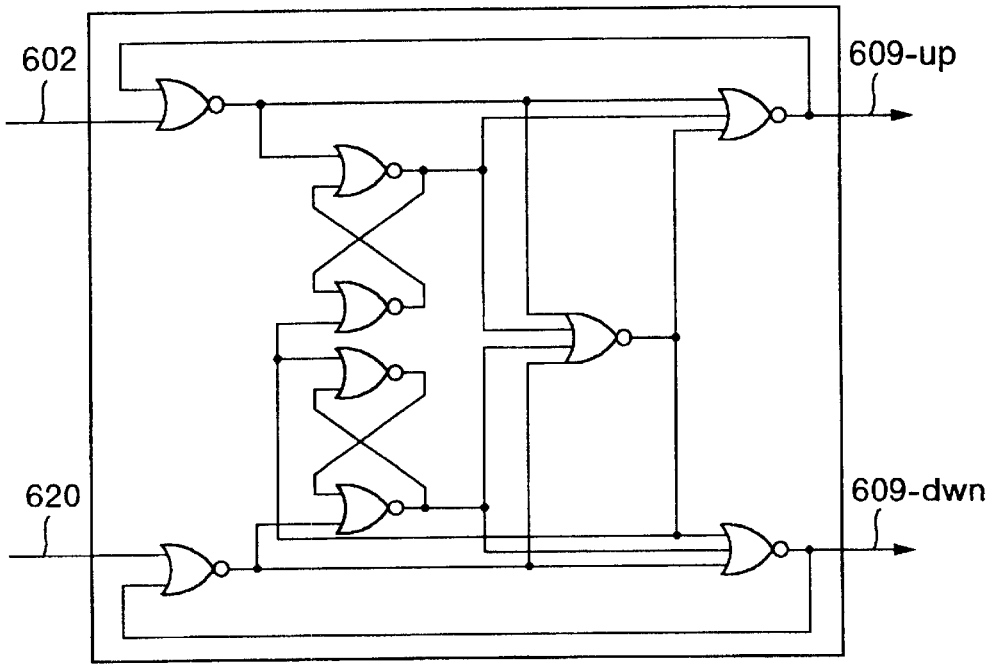
FIG. 4 is a circuit diagram showing the construction of a phase comparing circuit according to the first embodiment.
Figure 5:
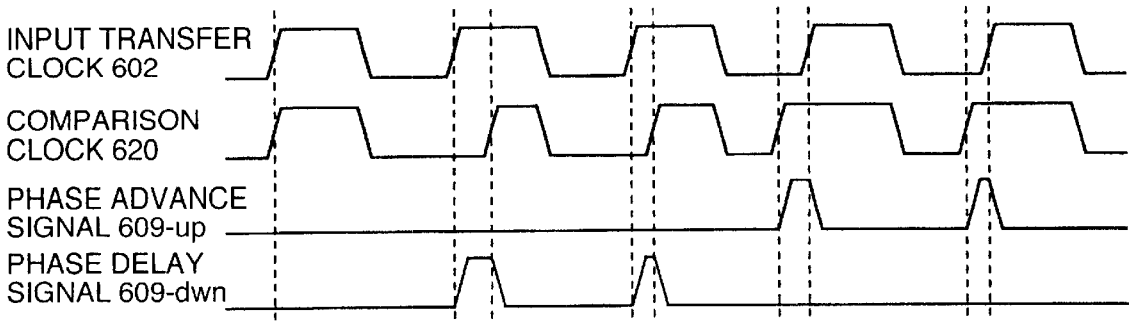
FIG. 5 is a chart showing an operation of the phase comparing circuit according to the first embodiment.
Figure 6:
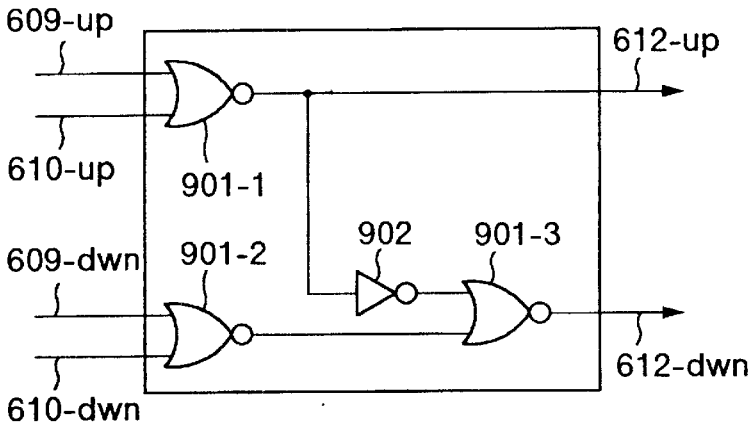
FIG. 6 is a circuit diagram showing the construction of an edge judging circuit according to the first embodiment.

FIG. 4 is a circuit diagram showing the construction of each of the phase comparing circuits 607 and 608 shown in FIG. 3. FIG. 5 is a timing chart showing an operation of the phase comparing circuit. FIG. 6 is a circuit diagram showing the construction of the edge judging circuit, which includes NOR circuits 901-1 to 901-3 and an inverting circuit 902.

Figure 7:
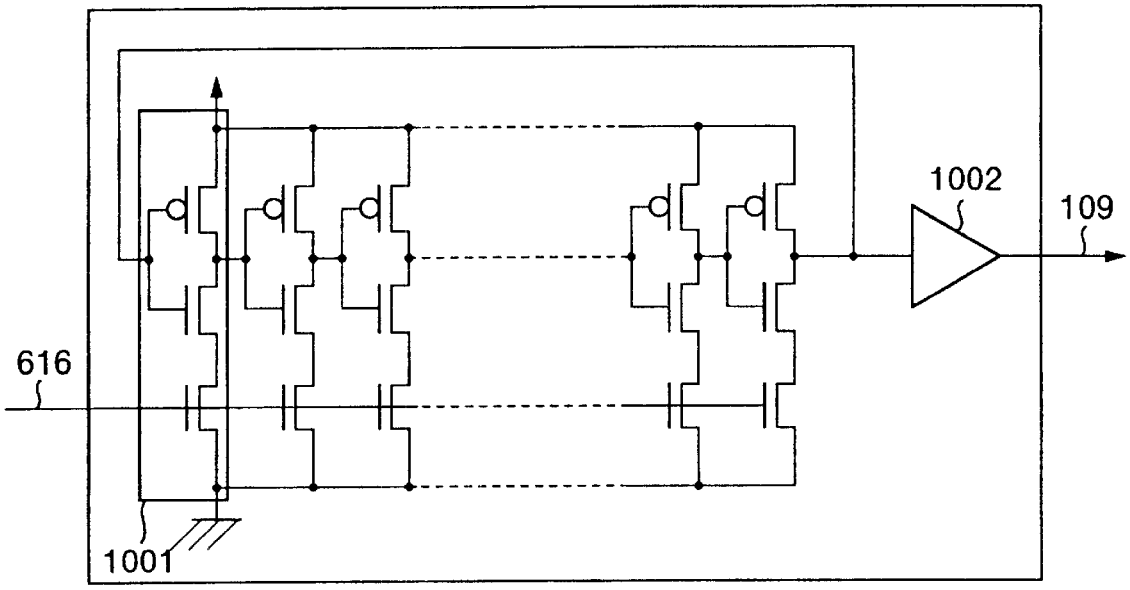
FIG. 7 is a circuit diagram showing the construction of a VCO according to the first embodiment.

FIG. 7 is a circuit diagram showing the construction of the VCO 617, wherein reference numeral 1001 denotes an inverting circuit with a bias input, and 1002 does an output buffer. The VCO 617 obtains its oscillation frequency in the manner that an odd number of inverting circuits 1001 are connected in series and the output of the last stage is used as an input of the first stage.

Figure 8:
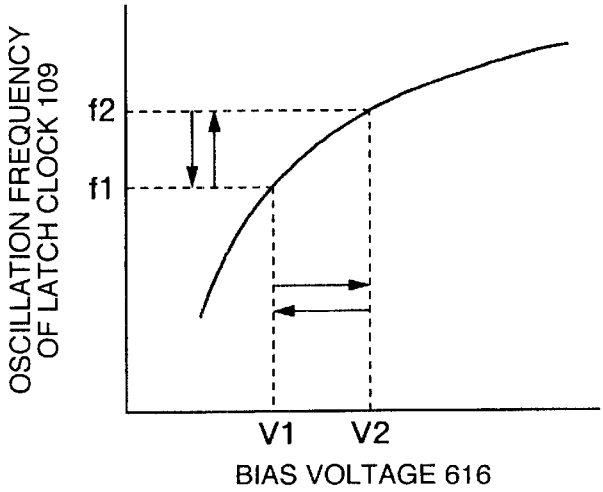
FIG. 8 is a graph showing a relation between bias voltage and VCO oscillation frequency according to the first embodiment.
Figure 9:
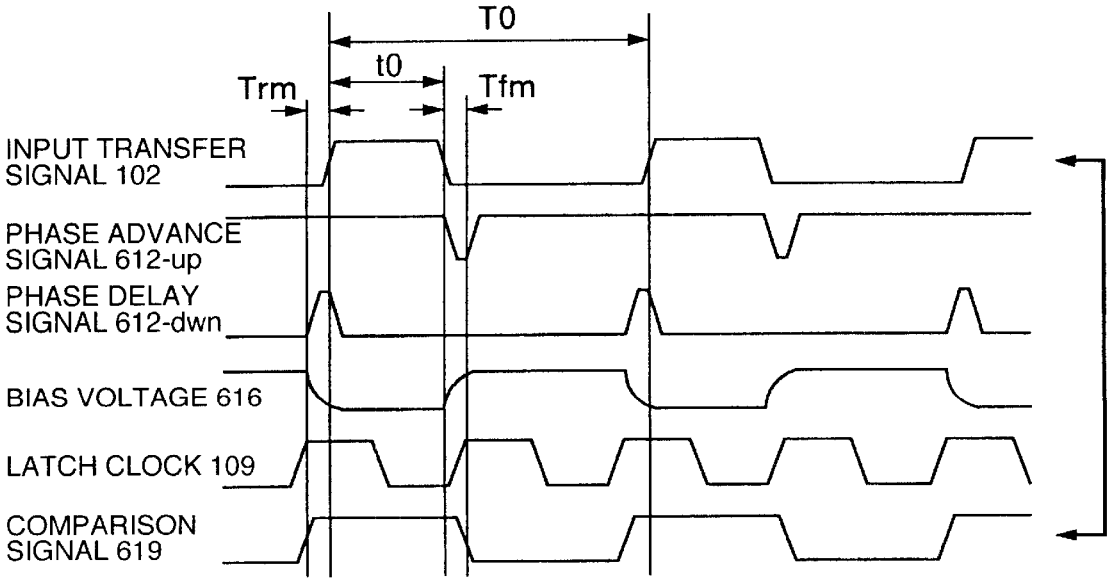
FIG. 9 is a timing chart of the clock reproducing circuit according to the first embodiment.
Figure 10:
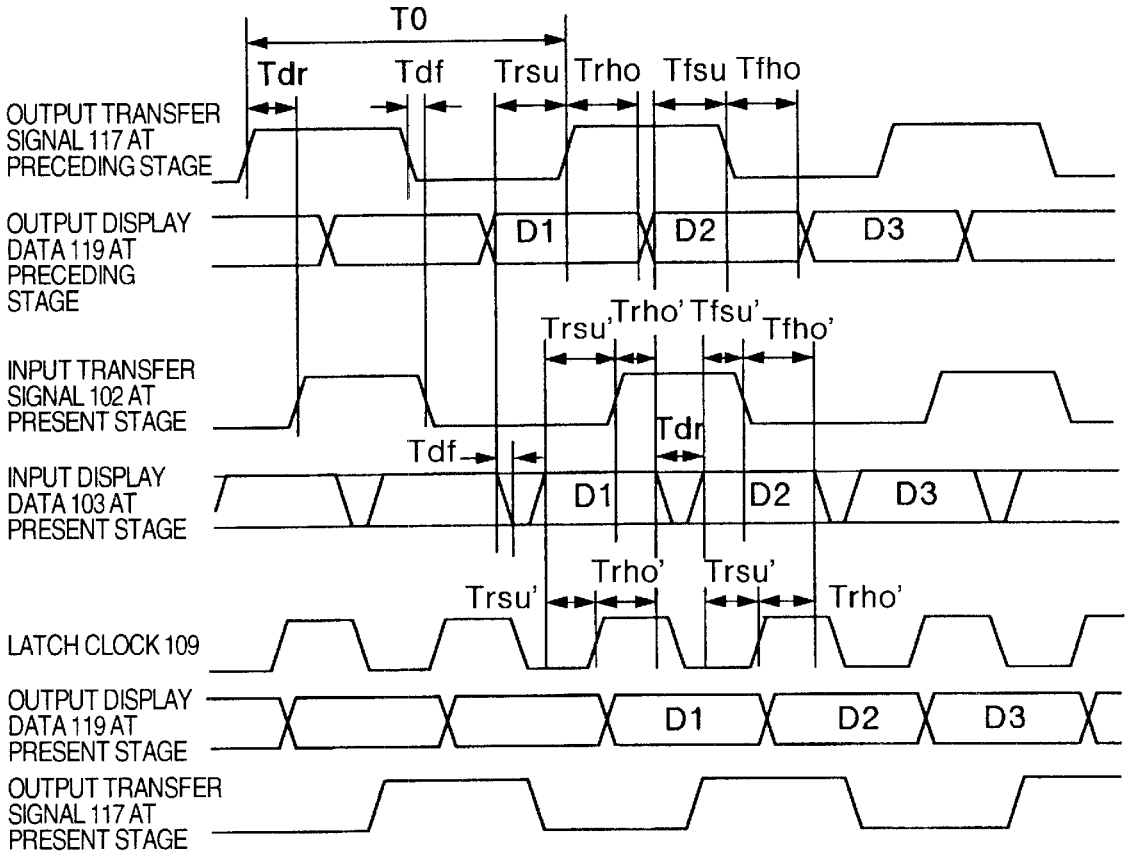
FIG. 10 is a timing chart of the data driver according to the first embodiment.

FIG. 8 is a graph showing a relation between bias voltage and the oscillation frequency of the VCO 617. FIG. 9 is a timing chart of the clock reproducing circuit 108. FIG. 10 is a timing chart of the data driver 101. The operation of this embodiment will be described with reference to the figures as mentioned above.

As shown in FIG. 2, the data driver signal group 505-1 generated in the liquid crystal controller 502 is transferred to the first stage data driver 503-1. The operation of each data driver 503 will be described. As shown in FIG. 10, the input transfer clock 102 is transferred from the circuit at the preceding stage with such timings that the input display data 103 can be taken in at each rising/falling edge. As already described in relation to the related art, however, the duty of the input transfer clock 102, the input display data 103, or the like, changes due to the output buffer in the preceding stage circuit, the input buffer in the present stage circuit, the impedances of the transfer lines, etc.

In each data driver 503, the latch clock 109 and the reproduced transfer signal 108 are first generated in the clock reproducing circuit 107 on the basis of the input transfer clock 102. This process will be described with reference to FIGS. 3 to 9. The input transfer clock 102 input to the clock reproducing circuit 107 passes through the input buffer 601 as shown in FIG. 3 and then it is input to the edge comparing circuit 607 for comparing it in rising edge with the comparison signal 619. On the other hand, the input transfer clock 602 and the comparison signal 619 are input to the inverting circuits 603 and 604, respectively. After being inverted, they are input to the edge comparing circuit 608 for comparing their falling edges with each other.

Either of the edge comparing circuits 607 and 608 is constructed as shown in FIG. 4. In their timing charts, e.g., in case of the edge comparing circuit 607, as shown in FIG. 5, the corresponding rising edges of the two input signals are compared with each other. If the timings of rising of both are the same, its outputs 609-up and 609-dwn are both set at low level. If rising of the input transfer clock 602 is earlier than that of the comparison clock 620, the output 609-dwn is set to high level in the period in which the input transfer clock 602 is to high level and the comparison clock 620 is at low level. Inversely, if rising of the input transfer clock 602 is later than that of the comparison clock 620, the output 609-up is set to high level in the period in which the input transfer clock 602 is to low level and the comparison clock 620 to at high level.

Therefore, in the clock generating circuit 107, for example, when the comparison signal 619 has the same cycle and duty as the input transfer clock 602 but the phase of the comparison signal 619 is a little late, in the edge comparing circuit 607, the phase delay signal 609-dwn is at high level during the period from rise of the input transfer clock 602 to rise of the comparison signal 619, the phase delay signal 610-dwn is at high level during the period from fall of the input transfer clock 602 to fall of the comparison signal 619, and any of the phase advance signals 609-up and 610-up and the phase delay signals 609-dwn and 610-dwn is at low level during the other periods. Consequently, these phase advance signals and phase delay signals give information on phase difference in relation to rise and fall of either of the input transfer clock 602 and the comparison signal 619.

The phase advance signals 609-up and 610-up and the phase delay signals 609-dwn and 610-dwn thus generated are input to the edge judging circuit 611, wherein the logical sum of phase difference information is made in relation to each of rise and fall, and thereby each piece of phase advance information and phase delay information in relation to rise and fall is obtained as a unit of information. Besides, in order to make a signal level suitable for the charge pump circuit 613 at the subsequent stage, when a phase difference in phase advance signal arises, a logical conversion is performed to make it at low level. Further, phase advance and phase delay must not occur at once in the phase difference signals, but, only by performing an OR operation, for example, a possibility may remain that there is a period in which either of the phase advance signal 609-up and the phase delay signal 610-dwn is at high level. For this reason, as for the phase delay signal, after an OR operation is performed in the NOR circuit 901-2, it is masked using the NOR circuit 901-3 by the phase advance signal that has been made high-active in the inverting circuit 902.

The phase advance signal 612-up and the phase delay signal 612-dwn thus generated are input to the charge pump circuit 613. As shown in FIG. 6, the charge pump circuit 613 inputs the phase advance signal 612-up to the gate of a PMOS whose source side has been set at a high potential level, and the phase delay signal 612-dwn to the gate of an NMOS whose source side has been set at a low potential level. The drain sides of the PMOS and the NMOS are connected to each other and the node between them gives the bias voltage 614. Therefore, if the phase advance signal 612-up becomes low level, the potential of the bias voltage 614 rises because a current flows in from the high potential side, and, if the phase delay signal 612-dwn becomes low level, the potential of the bias voltage 614 is lowered by flowing a current to the low potential side. Further, when the phase advance signal 612-up is at high level and the phase delay signal 612-dwn is at low level, the bias voltage 614 does not change because no current flows on either source side. The bias voltage 614 generated through the above-described process is input to the VCO circuit 617 after high-frequency components are removed from it by the loop filter 615.

Next, the operation of the VCO circuit 617 will be described. As shown in FIG. 8, the VCO circuit 617 shows a linear relation between bias voltage and oscillation frequency. Therefore, in the range between VL and VH of the bias voltage 614, a change in frequency when the bias voltage changes from V1 to V2 is equal to a change in frequency when the bias voltage changes from V2 to V1.

A signal generated in the above VCO circuit 617 is output from the clock reproducing circuit as the reproduced transfer clock 109. The signal is fed back to the edge comparing circuit 607 and also to the edge comparing circuit 608 through the inverting circuit 604.

As a result of the above operation, when a signal of a duty t0/T0% (T0: one cycle period of input signal, t0: period of high level) is input as the input transfer clock 602 at the input of the clock reproducing circuit 107, as shown in FIG. 9, the comparison signal 619 rises earlier than the input transfer clock 602 by a period trm, and falls earlier than the input transfer clock 602 by a period tfm. In this case, the periods trm and tfm are equal to each other because of the characteristic of the VCO circuit 617. That is, trm=tfm=(T0−t0)/2. Therefore, the comparison signal 619 has its duty of 50%, and it is a signal in which the delay time has changed in the forward and backward directions by the same width in relation to the input transfer clock 602. The same applies to the reproduced transfer clock 109 obtained by inverting the comparison signal 619.

On the basis of the latch clock 108 and the reproduced transfer clock 109 generated as above, the data driver 101 operates. So, a data taking-in method in case of using those latch clock and reproduced transfer clock will be described with reference to FIG. 10.

Even when the duty of either of the output transfer clock 117 and the display data 119 output from the data driver at the preceding stage is 50%, the input transfer clock 102 and the input display data 103 input to the present stage may have changed in duty because of the input and output buffers and the impedance of the transfer lines. However, in the case that the drive performances of the input and output buffers and the impedance of the transfer lines are the same in any transfer path, as shown in FIG. 10, when the transfer clock delays by Tdr seconds at each rise and by Tdf seconds at each fall, the display data also delays by Tdr seconds at each rise and by Tdf seconds at each fall. That is, the duty that was 50% for one cycle T0 changes to (50+(Tdf−Tdr)/T0)%. In the construction of FIG. 1, the input display data 103 is latched in the latch circuit 114 with the reproduced transfer clock 109. But, if it were latched with the input transfer clock 102, in case of Tdr>Tdf, as shown in FIG. 10, at each rising edge of the clock, the margin of setup time remains Trsu but the margin of hold time changes to Trho'=Trho−(Tdr−Tdf). On the other hand, at each falling edge, the margin of setup time changes to Tfsu'=Tfsu−(Tdr−Tdf). Since the margins of setup/hold times must be satisfied simultaneously upon rise and fall, as the whole circuit, the margin of setup time must be Tsu'=Tfsu−(Tdr−Tdf), and the margin of hold time must be Tho'=Trho−(Tdr−Tdf).

Contrastingly, in the case of using the reproduced transfer clock by applying the first embodiment, the duty becomes 50%. Since the reproduced transfer clock rises earlier than the input transfer clock by (Tdr−Tdf)/2 seconds and falls later than the input transfer clock by (Tdr−Tdf)/2 seconds, the margins of setup/hold times upon rise are Trsu"=Trsu−(Tdr−Tdf)/2 and Thsu"=Tfsu'+(Tdr−Tdf)/2=Tfsu−(Tdr−Tdf)/2, respectively, and the margins of setup/hold times upon fall are Tfsu"=Tfsu'+(Tdr−Tdf)/2=Tfsu−(Tdr−Tdf)/2 and Tfho"=Tfsu−(Tdr−Tdf)/2, respectively. Thus the difference in margin of either of setup/hold times between rise/fall of the clock is cancelled, and a margin of (Tdr−Tdf)/2 seconds is produced for either of setup/hold times. Accordingly, high speed transfer becomes possible.

Next, the second embodiment of the present invention in which a clock reproducing circuit different in construction from that of the first embodiment is used will be described with reference to FIGS. 1 and 11 to 17.

Figure 11:
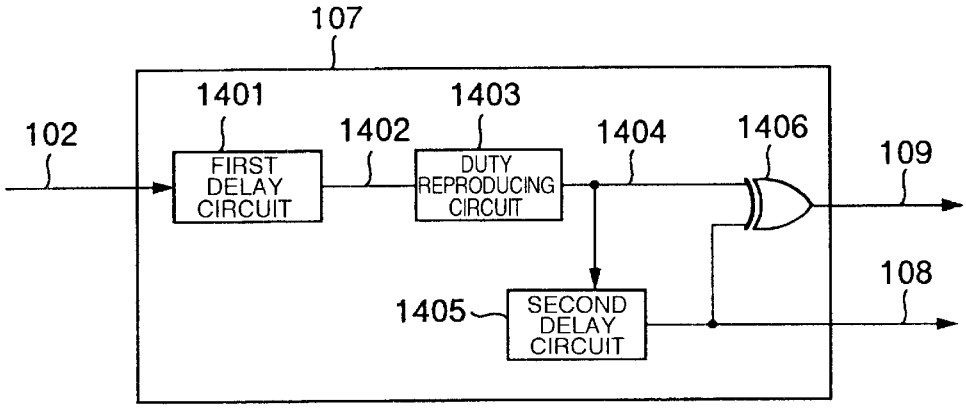
FIG. 11 is a block circuit diagram showing the construction of a clock reproducing circuit according to the second embodiment of the present invention.

FIG. 11 is a block circuit diagram showing the construction of the clock reproducing circuit according to the second embodiment. Reference numeral 1401 denotes a first delay circuit, which delays the phase of the input transfer clock 102 by half of its high level width to generate a delay transfer clock (1) 1402. Reference numeral 1403 denotes a duty reproducing circuit, which generates a reproduced transfer clock (1) 1404 with its duty of 50% synchronously with each rise of the delay transfer clock (1) 1402. Reference numeral 1405 denotes a second delay circuit, which has the same function as the first delay circuit 1401 and delays the phase of the reproduced transfer clock (1) 1404 by half of its high level width to generate the reproduced transfer clock 108. Reference numeral 1406 denotes an exclusive OR circuit, which performs an exclusive OR operation of the reproduced transfer clock (1) 1404 and the reproduced transfer clock 108 to generate the latch clock 109.

Figure 12:
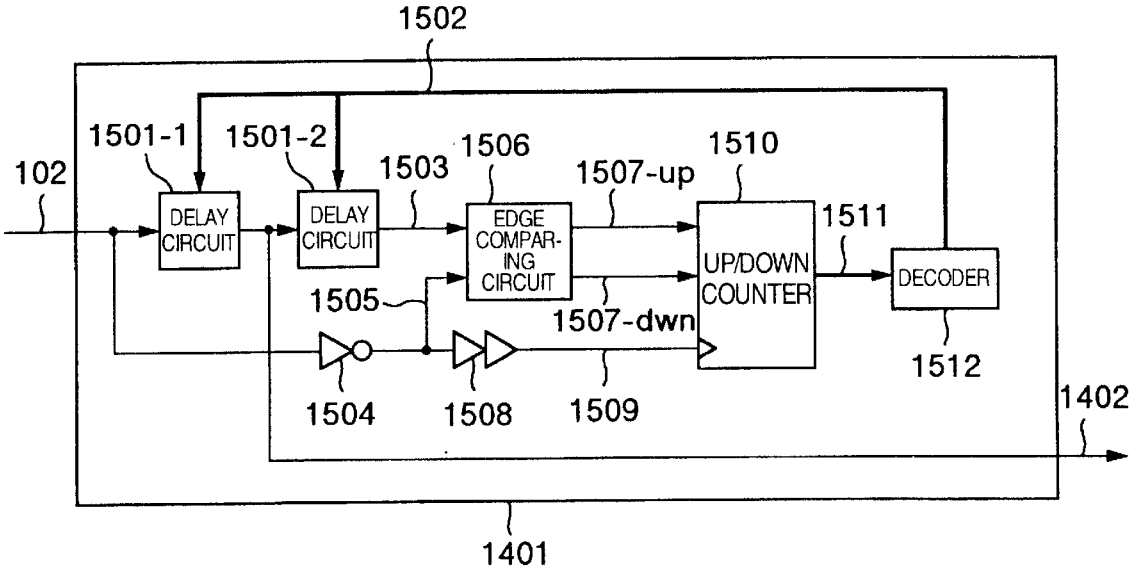
FIG. 12 is a block circuit diagram showing the construction of a first delay circuit according to the second embodiment.

FIG. 12 is a block circuit diagram showing the construction of the first delay circuit 1401. Reference numerals 1501-1 and 1501-2 denote delay circuits having the same construction, either of which delays its input signal on the basis of a delay control signal 1502. In this example, the delay circuit 1501-1 delays the input transfer clock 102 to generate the delay transfer clock (1) 1402, and the delay circuit 1501-2 delays the delay transfer clock (1) 1402 to generate a delay transfer clock (2) 1503. Reference numeral 1504 denotes an inverting circuit, and 1505 does the inverted signal of the input transfer clock 102 generated by the inverting circuit 1504. Reference numeral 1506 denotes an edge comparing circuit, which judges the difference in phase at each rising edge between the delay transfer clock (2) 1503 and the inverted signal 1505, and outputs the result as a phase advance signal 1507-up or a phase delay signal 1507-dwn. Reference numeral 1508 denotes a delay circuit, and 1509 does a delay signal of the inverted signal 1505. Reference numeral 1510 denotes an up/down counter, which operates synchronously with the delay signal 1509, and counts up when the phase advance signal 1507-up is effective and counts down when the phase delay signal 1507-dwn is effective, and outputs the result as a count signal 1511. Reference numeral 1512 denotes a decoder, which converts the count signal 1511 of n bits into the delay control signal 1502 in which only one bit of 2^n bits is effective.

Figure 13:
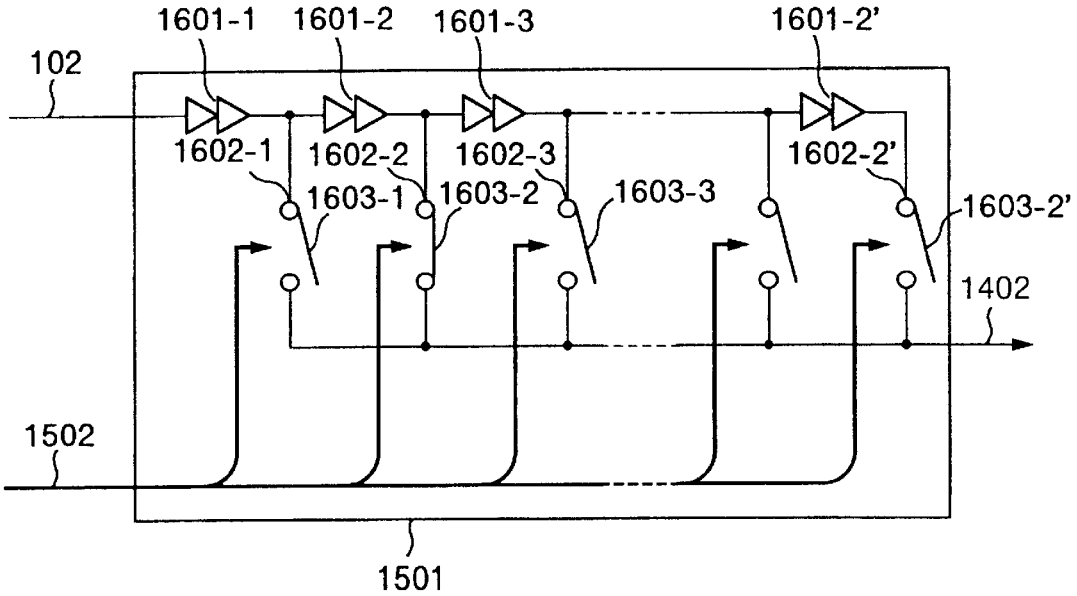
FIG. 13 is a circuit diagram showing the construction of a delay circuit according to the second embodiment.

FIG. 13 is a circuit diagram showing the construction of the delay circuit 1501. The delay circuit 1501 comprises 2^n delay circuits 1601-1 to 1601-2^n and delays the input transfer clock 102 as its input in 2^n steps to generate delay signals 1602-1 to 1602-2^n. Reference numerals 1603-1 to 1603-2^n denote switching circuits, one of which is turned on at most on the basis of the delay control signal 1502 of 2^n bits to obtain the delay transfer clock (1) 1402 as the output of the delay circuit 1501. The delay circuits 1501-1 and 1501-2 has the same construction.

Figure 14:
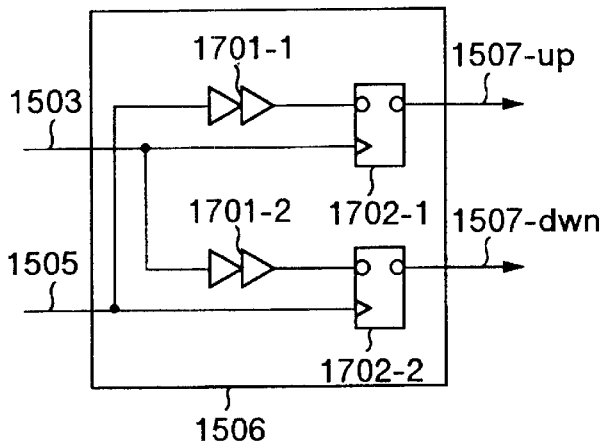
FIG. 14 is a circuit diagram showing the construction of an edge comparing circuit according to the second embodiment.

FIG. 14 is a circuit diagram showing the construction of the edge comparing circuit 1506. Reference numerals 1701-1 and 1701-2 denote delay circuits, and 1702-1 and 1702-2 do latch circuits. In the edge comparing circuit 1506 constructed as shown in FIG. 14, when the inverted signal 1505 advances in phase more than the delay transfer clock (2) 1503 by more than the delay quantity in the delay circuit 1701-1, the signal 1507-up becomes high level. Inversely, when the delay transfer clock (2) 1503 advances in phase more than the inverted signal 1505 by more than the delay quantity in the delay circuit 1701-2, the signal 1507-dwn becomes high level.

Figure 15:
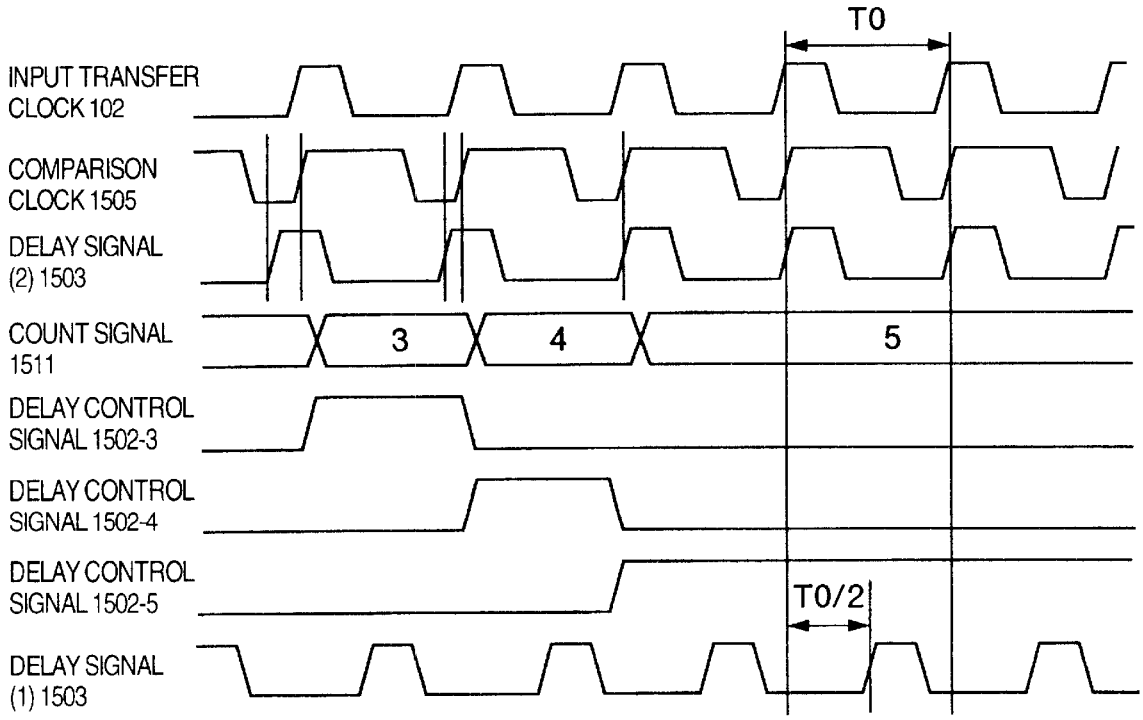
FIG. 15 is a timing chart of the first delay circuit according to the second embodiment.

FIG. 15 is a timing chart showing the operation of the first delay circuit.

Figure 16:
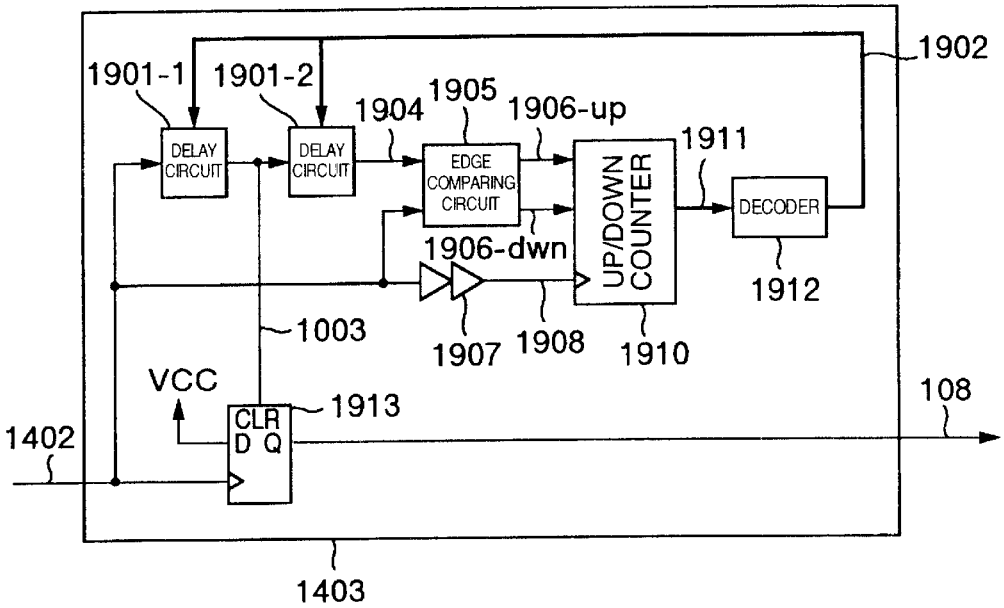
FIG. 16 is a block circuit diagram showing the construction of a duty reproducing circuit according to the second embodiment.

FIG. 16 is a block circuit diagram showing the construction of the duty reproducing circuit 1403. Reference numerals 1901-1 and 1901-2 denote delay circuits having the same construction, either of which delays its input signal on the basis of a delay control signal 1902. In this example, the delay circuit 1901-1 delays the delay transfer clock (1) 1402 to generate a clear signal 1903, and the delay circuit 1901-2 delays the clear signal 1903 to generate a delay transfer clock (3) 1904. Reference numeral 1905 denotes an edge comparing circuit, e.g., having the same function as that shown in FIG. 17, which compares the phases of the delay transfer clock (3) 1904 and the delay transfer clock (1) 1402, and outputs the result as a phase advance signal 1906-up or a phase delay signal 1906-dwn. Reference numeral 1907 denotes a delay circuit, and 1908 does a delay signal of the delay transfer clock (1) 1402 delayed in the delay circuit 1907. Reference numeral 1910 denotes an up/down counter, which operates synchronously with the delay signal 1908, and counts up when the phase advance signal 1906-up is effective and counts down when the phase delay signal 1906-dwn is effective, and outputs the result as a count signal 1911. Reference numeral 1912 denotes a decoder, which converts the count signal 1911 of n bits into the delay control signal 1902 in which only one bit of 2^n bits is effective. Reference numeral 1913 denotes a latch circuit having an edge clear function, which latches a high level voltage synchronously with the delay transfer clock (1) 1402, and performs an asynchronous clear operation upon fall of the clear signal 1903 to generate the reproduced transfer clock 108.

Figure 17:
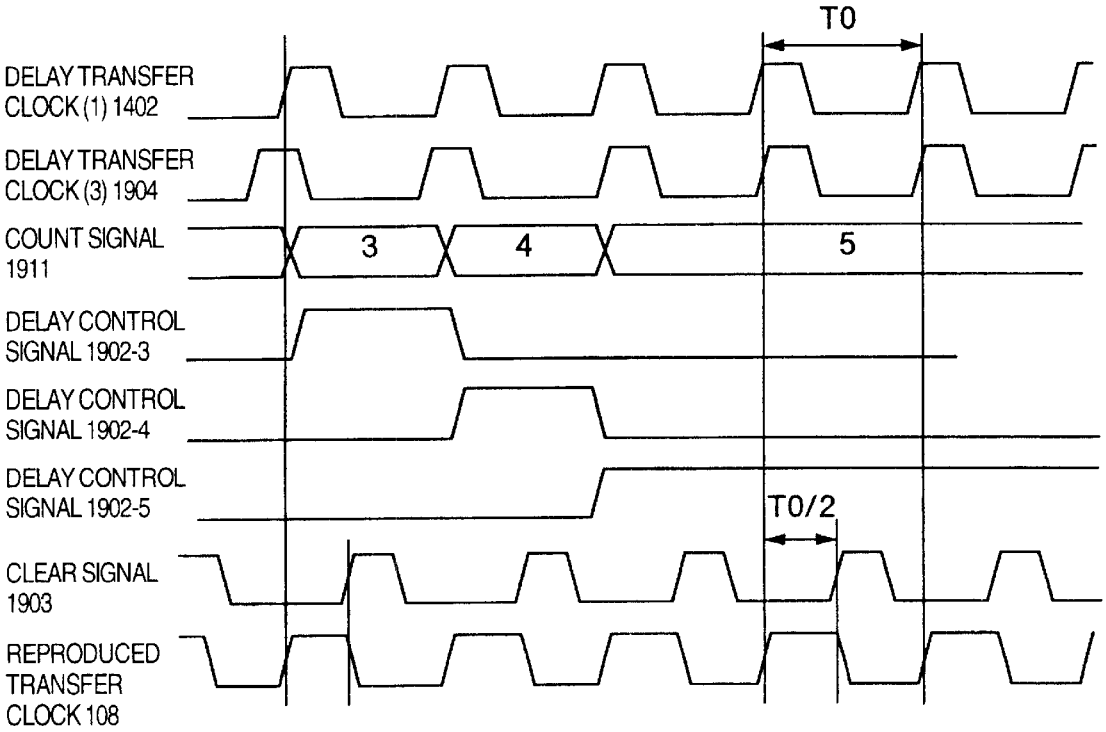
FIG. 17 is a timing chart of the duty reproducing circuit according to the second embodiment.

FIG. 17 is a timing chart showing the operation of the duty reproducing circuit. The operation of the second embodiment will be described in detail with reference to the figures as mentioned above.

Like the first embodiment, to the data driver 101 input is the input transfer clock 102 whose duty has changed. In the data driver 101, the input transfer clock 102 externally input is transferred to the clock reproducing circuit 107 of this embodiment as shown in FIG. 11. The operation of the clock reproducing circuit will be described with reference to FIGS. 12 to 17.

Referring to FIG. 12, the input transfer clock 102 is transferred to the delay circuit 1501-1. The delay circuit 1501-1 has the construction as shown in FIG. 13, wherein the input transfer clock 102 is delayed in 2^n steps using 2^n delay circuits 1601-1 to 1601-2^n. From the delay signals 1602-1 to 1602-2^n generated using those circuits, the delay transfer clock (1) 1402 is generated by selecting only one of the switching circuits 1603-1 to 1603-2^n. The delay transfer clock (1) 1402 thus generated is input to the delay circuit 1501-2. Since the delay circuit 1501-2 has quite the same construction as the delay circuit 1501-1 and the delay control signal is common, the delay time of the delay circuit 1501-2 is equal to that of delay circuit 1501-1. In this manner, through the delay circuit 1501-2, the delay transfer clock (2) 1503 is generated. The delay transfer clock (2) 1503 and the above-described inverted signal 1505 are input to the edge comparing circuit 1506. The edge comparing circuit 1506 has the construction as shown in FIG. 14. In the edge comparing circuit 1506, if the difference in phase between the input signals is within the range of the delay time determined by the delay circuit 1701-1 or 1701-2, the difference in phase between the signals 1503 and 1505 is digitally considered to be a multiple of their cycle, and either of the phase advance signal 1507-up and the phase delay signal 1507-dwn becomes low level. If the delay transfer clock (2) 1503 advances more than the inverted signal 1505 by more than the delay time by the delay circuit 1701-1, the signal 1507-up becomes high level. If the inverted signal 1505 advances more than the delay transfer clock (2) 1503 by more than the delay time by the delay circuit 1701-2, the signal 1507-dwn becomes high level. This circuit has the same meaning as the edge comparing circuits 607 and 608 in the first embodiment. In this embodiment, since information on width of the phase difference is not so important, the circuit shown in FIG. 14 can be used.

The phase advance signal 1507-up and the phase delay signal 1507-dwn are input to the up/down counter 1510 together with the delay signal 1509. On the basis of the delay signal 1509, the up/down counter 1510 counts up when the phase advance signal 1507-up is at high level, and counts down when the phase delay signal 1507-dwn is at high level. Therefore, as shown in the operation timing chart of FIG. 15, the up/down counter 1510 counts up as three, four, and five while the phase advance signal 1507-up is at high level, stops counting when either of the signals 1507-up and 1507-dwn becomes low level, and then holds the counted value. The count signal 1511 of n bits generated as above is decoded by the decoder 1512 into 2^n bits to generate the delay control signal 1502. By the above operation, when a rising edge of the delay signal (3) 1503 is within a certain range in relation to the corresponding rising edge of the input transfer clock 102 and thereby both rising edges can be considered to be equal, this condition can be held.

Since the delay circuits 1501-1 and 1501-2 have the same construction, each rising edge of the delay transfer clock (1) 1402 generated in the delay circuit 1501-1 is shifted by half the high-level period of the input transfer clock 102.

Next, the operation of the duty reproducing circuit 1403 will be described with reference to FIGS. 16 and 17. The delay transfer clock (1) 1402 is transferred to the delay circuit 1901-1 as well as the latch circuit 1913. The delay circuit 1901-1 has the construction shown in FIG. 13 like the delay circuit 1501-1, wherein only one switching circuit is selected with the delay control signal 1902 to generate the reset signal 1903. The reset signal 1903 is applied to the latch circuit 1913 as its clear signal and also input to the delay circuit 1901-2. Since the delay circuits 1901-1 and 1901-2 has quite the same construction and the delay control signal is common, the delay times of the delay circuits 1901-1 and 1901-2 are equal to each other. The process of generating the delay control signal 1902 is the same as the process in the case of the first delay circuit 1401 described with reference to FIG. 15. The latch circuit 1913 latches high level at each rising edge of the delay transfer clock (1) 1402 and it is cleared to low level at each rising edge of the clear signal 1903. As a result, as shown in FIG. 17, the reproduced transfer signal 108 as the output of the latch circuit 1913 has the same cycle as the input transfer signal 102 and has its duty of 50%. Further, since the phase of the delay transfer clock (1) 1402 is shifted relatively to the input transfer clock 102 by half the cycle of the high-level width of the latter, the phase of the reproduced transfer clock 108 is also shifted by half the cycle of the high-level width of the input transfer clock 102. The objective signal can be generated thereby. The reproduced transfer clock 108 thus generated is further input to the second delay circuit 1405. The second delay circuit 1405 has quite the same construction as the first delay circuit 1401 and outputs a signal shifted by half the cycle of the high-level width of the input signal. Since the duty of the reproduced transfer clock 1404 as the input signal to the second delay circuit 1405 is 50%, the phase of the reproduced transfer clock 108 is shifted relatively to the reproduced transfer clock 1404 by quarter the cycle. These two signals are subjected to an exclusive OR operation in the exclusive OR circuit 1406 to generate the latch clock 109.

Through the above-described process, it becomes possible to generate a signal which has the same cycle as the input transfer clock 102, and its duty of 50%, and which rises earlier (or later ) and falls later (or earlier) than the input transfer clock 102 by half the time of the duty difference from the latter. Thus it becomes possible to make a reproduced transfer clock having the same effect of that in the first embodiment, using only digital circuits.

In the above embodiments, only a liquid crystal display device in which data drivers are cascade-connected has been described. However, the present invention is, of course, not limited to this but it can be applied also to a system in which data drivers are connected in parallel. Further, it is needless to say that the present invention is not limited to liquid crystal display devices but can be applied to any device which has a possibility of the duty of data changing because the device includes transfer lines and input and output buffers.

According to the first and second embodiments of the present invention, by providing a reproducing circuit for a transfer clock in each data driver, it becomes easy to take display data in the driver at each stage, and it becomes possible to transfer a transfer signal and the display data to the driver at the next stage without changing their duties. Hence, more data divers can be connected. Further, an increase in either of setup/hold margins of the display data becomes possible. Besides, raising the transfer frequency becomes possible. As a result of these effects, even in a liquid crystal display device of cascade connection that can realize a reduction of price, an increase in size of screen and improvement in resolution can be realized.

What is claimed is:

1. A liquid crystal display device for displaying display data comprising:

a liquid crystal panel including pixel elements arranged in a matrix form;

a plurality of data drivers for applying graduation voltages corresponding to said display data, to said pixel elements;

a gate driver for selecting a pixel element to which a graduation voltage is to be applied; and a liquid crystal control circuit for controlling said data drivers on the basis of a transfer clock, wherein said data drivers each comprising a reproducing circuit for reproducing the transfer clock input to the data driver such that the deviations between the duties of the display data and said transfer clock input to said data driver and the duties of the display data and the transfer clock output from said data driver become small, and for generating a latch clock, and a latch circuit for latching said display data input to said data driver.

2. The device according to claim 1, wherein said plurality of data drivers are cascade-connected with each other.

3. The device according to claim 1, wherein said reproducing circuit further comprises a comparing circuit for comparing said transfer clock input to said data driver with said transfer clock reproduced in said reproducing circuit.

4. The device according to claim 3, wherein said transfer clock reproduced in said reproducing circuit rises earlier than said transfer clock input to said data driver by a period t, and falls later than said transfer clock input to said data driver by said period t.

5. The device according to claim 3, wherein, when the cycle of the transfer clock synchronous with display data is T0 and the difference between its low level period and its high level period is Tx, said reproducing circuit newly generates a signal that rises earlier than said transfer clock by a period Tr, and falls later than said transfer clock by a period (Tx−Tr), where $Tx>Tr>0$ when $Tx>0$, and $0>Tr>Tx$ when $Tx<0$.

6. A liquid crystal display device for displaying display data comprising:

a liquid crystal panel including pixel elements arranged in a matrix form;

a plurality of data drivers for applying graduation voltages corresponding to said display data, to said pixel elements;

a gate driver for selecting a pixel element to which a graduation voltage is to be applied; and a liquid crystal control circuit for outputting a transfer clock and said display data to said data drivers, wherein said data drivers each comprising a reproducing circuit for reproducing the transfer clock input to the data driver such that the deviations between the duties of said display data and said transfer clock output from said liquid crystal control circuit and the duties of the display data and the transfer clock output from said data driver become small, and for generating a latch clock, and a latch circuit for latching said display data input to said data driver.

7. The device according to claim 6, wherein either of said duties of said display data and said transfer clock output from said liquid crystal control circuit is 50%.

8. A liquid crystal display device for displaying display data comprising:

a liquid crystal panel including pixel elements arranged in a matrix form;

a plurality of data drivers cascade-connected with each other for applying graduation voltages corresponding to said display data, to said pixel elements;

a gate driver for selecting a pixel element to which a graduation voltage is to be applied; and a liquid crystal control circuit for outputting a transfer clock and said display data to said data drivers, wherein said data drivers each comprising a latch circuit for latching said display data so as to increase the margins of setup/hold times of said display data input to the data driver;

wherein each of said data drivers further comprises a doubling circuit for doubling the transfer clock converted in a converting circuit, and takes in said display data on the basis of the doubled transfer clock.

9. The device according to claim 8, wherein each of said data drivers generates a latch clock on the basis of said transfer clock such that said margins of said setup/hold times of said display data input to said data driver increase, and outputs said latch clock to said latch circuit.

* * * * *